US011428104B2

(12) United States Patent
Paradis

(10) Patent No.: US 11,428,104 B2
(45) Date of Patent: Aug. 30, 2022

(54) PARTITION ARRANGEMENT FOR GAS TURBINE ENGINE AND METHOD

(71) Applicant: PRATT & WHITNEY CANADA CORP., Longueuil (CA)

(72) Inventor: Vincent Paradis, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 244 days.

(21) Appl. No.: 16/524,911

(22) Filed: Jul. 29, 2019

(65) Prior Publication Data

US 2021/0032998 A1 Feb. 4, 2021

(51) Int. Cl.
*F01D 5/02* (2006.01)
*F01D 11/04* (2006.01)

(52) U.S. Cl.
CPC ..... *F01D 5/025* (2013.01); *F01D 11/04* (2013.01); *F05D 2220/32* (2013.01); *F05D 2240/24* (2013.01); *F05D 2240/55* (2013.01); *F05D 2240/60* (2013.01)

(58) Field of Classification Search
None
See application file for complete search history.

(56) References Cited

U.S. PATENT DOCUMENTS 5,316,346 A 5/1994 Maurer
5,340,319 A 8/1994 Enomoto et al.
5,350,278 A 9/1994 Burge
5,755,556 A 5/1998 Hultgren et al.
6,322,306 B1 11/2001 Dutton
6,331,097 B1 * 12/2001 Jendrix ..... F01D 5/3015 416/96 R
6,422,812 B1 7/2002 Pepi et al.
6,428,272 B1 8/2002 Pepi et al.
6,481,959 B1 11/2002 Morris et al.
6,588,303 B1 7/2003 Walsh
6,641,326 B2 11/2003 Schilling et al.
6,932,567 B2 8/2005 Albers et al.
6,991,429 B2 1/2006 Uematsu et al.
7,144,218 B2 12/2006 Dube et al.
7,452,188 B2 * 11/2008 Bouchard ..... F01D 5/066 416/204 R (Continued)

FOREIGN PATENT DOCUMENTS

CA 2928980 11/2016
GB 2498321 7/2017

*Primary Examiner* — Courtney D Heinle
*Assistant Examiner* — Jason Fountain
(74) *Attorney, Agent, or Firm* — Norton Rose Fulbright Canada LLP

(57) ABSTRACT

The turbine rotor assembly can include a turbine rotor disc drivingly mounted to a shaft for rotation about a rotation axis and having a central aperture extending coaxially with the shaft through the turbine rotor disc and being defined by a radially inner surface of the turbine rotor disc, a cavity downstream of and housing at least a part of the turbine rotor disc, a nut secured to the shaft and extending across the central aperture, a first air passage defined between an outer surface of the nut and the radially inner surface of the turbine rotor disc and fluidly connected to the cavity, a second air passage defined radially inward of the first air passage by an inner surface of the shaft and an inner surface of the nut.

18 Claims, 5 Drawing Sheets

(56) References Cited

U.S. PATENT DOCUMENTS 7,556,474 B2 7/2009 Marchi
7,581,931 B2 9/2009 Shaefer et al.
7,585,148 B2 9/2009 Hoell
7,942,635 B1 5/2011 Murray
7,958,734 B2 6/2011 Paprotna et al.
8,011,884 B1 9/2011 Murray
8,038,377 B2 10/2011 Ichiryu
8,086,933 B2 12/2011 Yamaga
8,186,939 B2 5/2012 Lecuyer et al.
8,206,080 B2 6/2012 Howe et al.
8,240,043 B2 8/2012 Duesler et al.
8,246,305 B2 * 8/2012 Lecuyer ..... F01D 5/027 416/95
8,382,432 B2 2/2013 Grissino et al.
8,677,728 B2 3/2014 Kovasity et al.
8,985,961 B2 3/2015 Chrzastek et al.
8,992,173 B2 3/2015 Farah et al.
9,004,852 B2 4/2015 Dakowski et al.
9,051,849 B2 6/2015 Ring et al.
9,217,334 B2 12/2015 Harris, Jr. et al.
9,249,676 B2 2/2016 Antonellis et al.
9,297,536 B2 3/2016 Eastwood et al.
9,316,153 B2 4/2016 Patat et al.
9,353,767 B2 5/2016 Richardson et al.
9,482,115 B2 11/2016 Harris et al.
9,506,364 B2 11/2016 Tanaka et al.
9,506,403 B2 11/2016 Clarke
9,512,725 B2 12/2016 Light et al.
9,599,132 B2 3/2017 Wyndon
9,771,983 B2 9/2017 Marks
9,828,880 B2 11/2017 Ballard, Jr. et al.
9,896,971 B2 2/2018 Richardson
9,932,986 B2 4/2018 DiBenedetto
10,094,285 B2 10/2018 Munshi et al.
10,113,561 B2 10/2018 Filipenco et al.
10,196,975 B2 2/2019 MacFarlane
10,265,838 B2 4/2019 Kolvick et al.
10,294,808 B2 5/2019 Simonds
10,301,960 B2 5/2019 Stapleton et al.
2007/0286733 A1 * 12/2007 Bouchard ..... F01D 5/066 416/204 R
2011/0081253 A1 * 4/2011 Lecuyer ..... F01D 5/027 416/96 R
2014/0023490 A1 1/2014 Hillier
2015/0096304 A1 4/2015 von der Esch et al.
2016/0076578 A1 3/2016 Bellino et al.
2016/0102556 A1 4/2016 Twell
2016/0153302 A1 6/2016 Samudrala et al.
2017/0044908 A1 2/2017 Griffin et al.
2017/0321739 A1 11/2017 Manem et al.
2019/0218923 A1 * 7/2019 Breen ..... F01D 5/32

* cited by examiner

PARTITION ARRANGEMENT FOR GAS TURBINE ENGINE AND METHOD

TECHNICAL FIELD

The application relates to arrangements for drivingly coupling a turbine rotor of a gas turbine engine to a power source of the gas turbine engine.

BACKGROUND OF THE ART

Arrangements used for connecting turbine rotors of gas turbine engines to one or more power sources of the gas turbine engines may be suitable for their intended purposes. However, improvements in the aircraft industry are always desirable.

SUMMARY

In one aspect, there is provided a turbine rotor assembly for a gas turbine engine, comprising a turbine rotor disc drivingly mounted to a shaft for rotation about a rotation axis and having a central aperture extending coaxially with the shaft through the turbine rotor disc and being defined by a radially inner surface of the turbine rotor disc, a cavity downstream of and housing at least a part of the turbine rotor disc, a nut secured to the shaft and extending across the central aperture, a first air passage defined between an outer surface of the nut and the radially inner surface of the turbine rotor disc and fluidly connected to the cavity, a second air passage defined radially inward of the first air passage by an inner surface of the shaft and an inner surface of the nut and extending to a location downstream of the cavity, and a seal downstream of the turbine rotor disc cooperating with the nut to fluidly segregate the first air passage from the second air passage.

In accordance with another aspect, there is provided a gas turbine engine comprising: a shaft rotatable about a rotation axis; a turbine rotor disc drivingly mounted to the shaft for rotation about the rotation axis and having turbine blades extending into a gas path of the gas turbine engine and a central aperture extending coaxially with the shaft through the turbine rotor disc, the central aperture defined by a radially inner surface of the turbine rotor disc; a nut secured to the shaft via a female thread of the nut and extending from the female thread through at least a part of the central aperture; a cavity downstream of and housing at least a part of the turbine rotor disc and fluidly connected to the gas path, the cavity fluidly connected to a high pressure compressor section of the gas turbine engine via a first air passage defined between an outer surface of the nut and the radially inner surface of the turbine rotor disc; a second air passage defined radially inward of the first air passage by an inner surface of the shaft and an inner surface of the nut and extending to a point downstream of the cavity, the second air passage fluidly connected to a low pressure compressor section of the gas turbine engine; and an outer surface of the nut cooperating with one of: an inner surface of a second nut connecting the nut to the turbine rotor disc, and a partition of the gas turbine engine defining the cavity, to define a seal, the nut and the seal fluidly segregating the first air passage from the second air passage.

In accordance with still another aspect, there is provided a method of fluidly connecting a high pressure compressor section of a gas turbine engine to a first cavity housing a downstream side of a first turbine rotor disc rotatable with a first shaft while fluidly segregating the cavity from a second cavity fluidly connected to a low pressure compressor section of the engine and housing at least a part of a second turbine rotor disc of the engine rotatable with a second shaft that is coaxial with the first shaft, comprising: inserting a first nut into a central aperture extending through the first turbine rotor disc; threading a female thread in an upstream end of the first nut over a male thread on the first shaft to define: a first air passage in the central aperture between an outer surface of the first nut and a surface of the first turbine rotor disc defining the central aperture, the first air passage fluidly connecting the high pressure compressor section to the first cavity, and a second air passage radially inwardly of the first air passage between inner surfaces of the first nut and shaft and an outer surface of the second shaft, the second air passage fluidly connecting the low pressure compressor section to the second cavity; and engaging a second nut to both: i) a downstream end of the first nut, and ii) a partition fluidly segregating the first cavity from the second cavity, to define a non-rotational sealed interface between the first and second nuts and a rotational sealed interface between the second nut and the partition, the first and second nuts and the partition fluidly segregating the first air passage from the second air passage.

BRIEF DESCRIPTION OF THE DRAWINGS

Reference is now made to the accompanying figures in which.

DETAILED DESCRIPTION

The terms "higher", "high pressure", "intermediate", "intermediate pressure", "lower", "low pressure", and the like, in this document refer to relative pressures and do not connote any particular absolute values of pressures.

Figure 1:
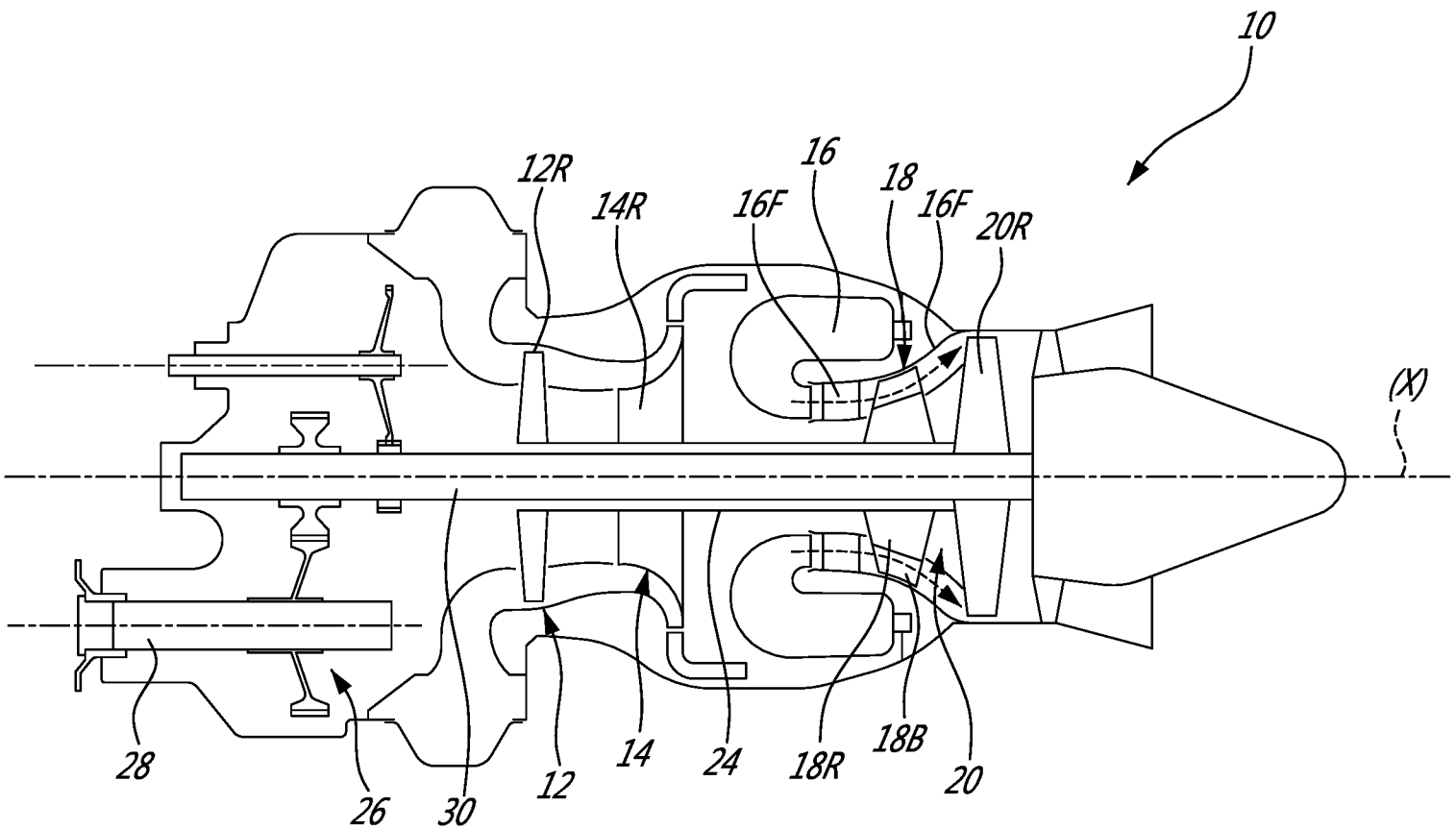
FIG. 1 is a schematic cross-sectional view of a gas turbine engine.

FIG. 1 illustrates an example of a gas turbine engine 10. In this example, the gas turbine 10 is a turboshaft engine 10, but may be another type of gas turbine engine, such as a turboprop or a turbofan engine for example. Thus, while the present technology is illustrated with respect to the turboshaft engine 10, the present technology may likewise be implemented in other gas turbine engines. Also, while the present technology is illustrated with respect to a particular turbine disc and a particular shaft of the engine 10, the present technology may likewise be implemented with respect to one or more other discs and other one or more corresponding shafts of the engine 10.

As shown in FIG. 1, the engine 10 of the present embodiment comprises in serial flow communication a lower pressure (LP) compressor section 12 comprising one or more LP compressor rotors 12R, and a higher pressure (HP) compressor section 14 comprising one or more HP compressor rotor discs 14R. The turbine sections 12, 14 pressurize and supply air to a combustor 16 in which the compressed air is mixed with fuel and ignited for generating an annular stream of hot combustion gases. The stream of hot combustion gases flows via a gas path 16F through a HP turbine section 18 comprising one or more HP turbine rotor discs 18R having turbine blades 18B extending into the gas path 16F for extracting energy from the combustion gases.

The stream of hot combustion gases then flows through a LP turbine section 20 comprising one or more LP turbine rotor discs 20R having turbine blades 20B extending into the gas path 16F downstream of the turbine blades 18B, for further extracting energy from the combustion gases. The HP turbine section 18 connects to and drives the HP compressor section 14 and the LP compressor section 12 via a HP shaft 24. The LP turbine section 20 connects to and drives a gearbox 26 having an output shaft 28, via a LP shaft 30. In other embodiments, as an example, the LP shaft 30 may drive a fan instead of a shaft 30. In this embodiment, the shafts 24, 30 and the compressor and turbine sections 12, 14, 16, 18 are all rotatable about a common rotation axis (X) of the engine 10.

Figure 2:
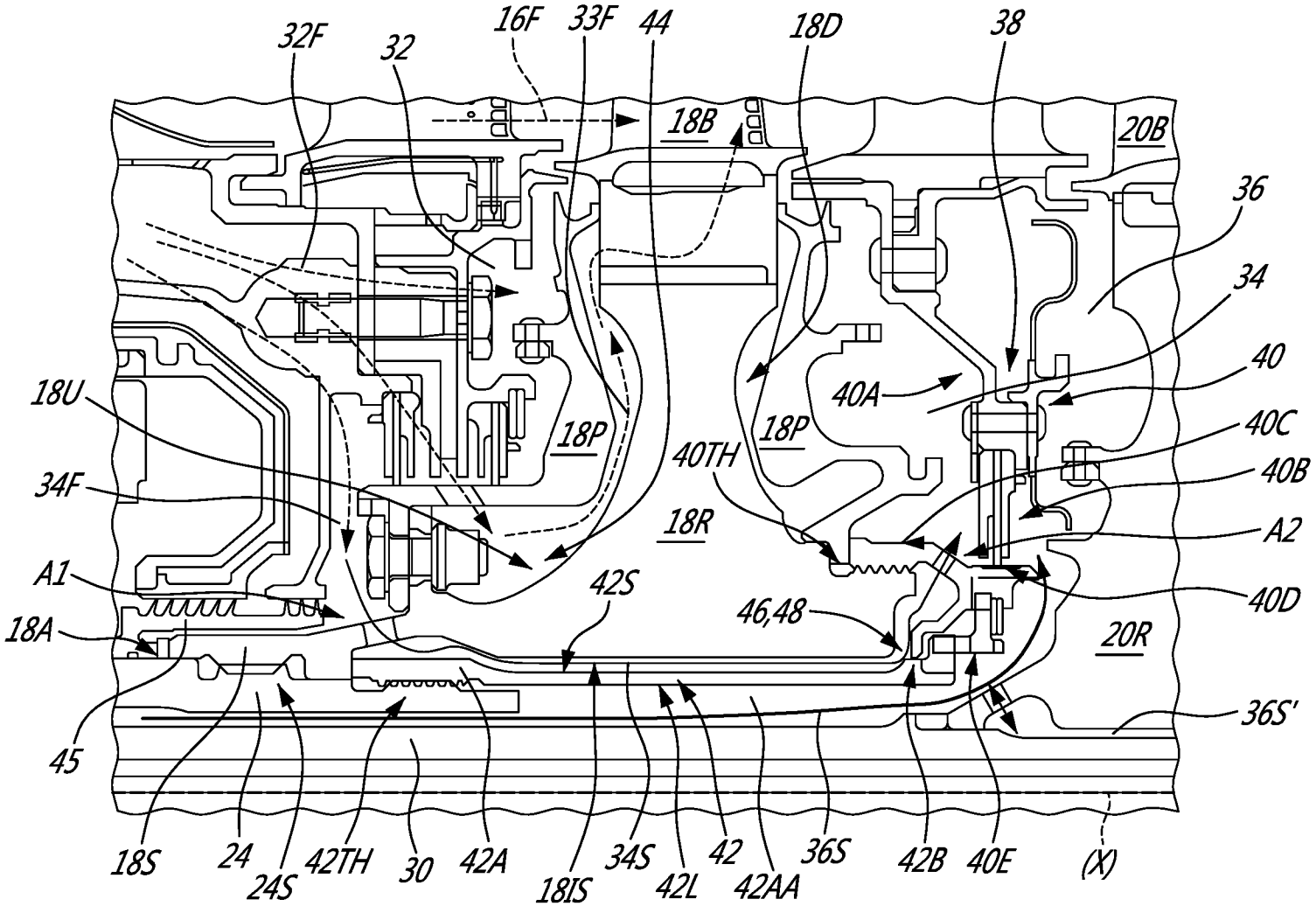
FIG. 2 is a section view of a part of the gas turbine engine of FIG. 1, the part including a fastener arrangement connected to a higher pressure turbine rotor of the gas turbine engine.

Now referring to FIG. 2, a part of the engine 10 and parts of the HP turbine section 18 and the LP turbine section 20 are shown in more detail. In this embodiment, the HP turbine section 18 has an HP turbine rotor disc 18R mounted to the HP shaft 24 and rotatable therewith about the rotation axis (X). As shown, the HP turbine rotor disc 18R is housed at least in part in a cavity 32 and an cavity 34 which are defined in the engine 10. More particularly, in this embodiment the cavity 32 houses an upstream side of the HP turbine rotor disc 18R and the cavity 34 houses a downstream side of the disc 18R. As shown, the cavities 32 and 34 are fluidly connected to the gas path 16F at axially opposed sides of the blades 18B of the disc 18R.

Further as shown, the LP turbine section 20 has an LP turbine rotor disc 20R mounted to the LP shaft 30 downstream of the HP turbine rotor disc 18R and rotatable with the LP shaft 30 about the rotation axis (X). As shown, the LP turbine rotor disc 20R is housed at least in part in a cavity 36 on an upstream side of the disc 20R and in another cavity (not shown) on a downstream side thereof, which are defined in the engine 10. More particularly, in this embodiment the cavity 36 houses an upstream side of the LP turbine rotor disc 20R and the other cavity downstream of the cavity 36 houses a downstream side of the LP turbine rotor disc 20R. Similar to the cavities 32 and 34 associated with the HP turbine rotor disc 18R, the cavities 36 associated with the LP turbine rotor disc 20R are also fluidly connected to the gas path 16F at axially opposed sides of the blades 20B of the disc 20R. In this embodiment, the cavities 32, 34, 36 are annular and extend around the shafts 24, 30. In other embodiments, one or more of the cavities 32, 34, 36 may be of a different shape and/or configuration.

In this embodiment, the cavity 32 is fluidly connected to the HP compressor section 14 of the engine 10, as shown schematically, via an air passage 32F, and is fed with compressed air from the HP compressor section 14. Further in this embodiment, the cavity 34 is fluidly connected to the HP compressor section 14 of the engine 10 via an air passage 34F that fluidly connects into an air passage 34S, and is fed with compressed air from the HP compressor section 14. Further as shown, air outlets (not labeled) in the turbine blades 18B of the HP turbine rotor disc 18R may be fed with air from the HP compressor section 14 via an additional air passage 33F extending from the HP compressor section 14 through, inter alia, a cover plate 18P at an upstream side of the disc 18R.

The air passages 32F, 33F and 34F may be defined in any suitable way, and may be conventional for example, and are therefore not described herein in detail. In this embodiment, the cavity 36 associated with the LP turbine rotor disc 20R is fluidly connected to the LP compressor section 12 of the engine 10, via an air passage 36S, and is fed with compressed air from the LP compressor section 12. As shown, in this embodiment, the air passage 36S extends through an interface between an inner surface of the HP shaft 24 and an outer surface of the LP shaft 30 which extends at least in part through the HP shaft 24 coaxially with the HP shaft 24. In other embodiments, a different routing may be used. As shown in FIG. 2, the downstream cavity associated with the LP turbine rotor disc 20R, which is downstream of the cavity 36, is fed with air via an air passage 36S' that branches off from the air passage 36S and extends to that other cavity through a central aperture of the LP turbine rotor disc 20R.

In operation, compressed air from the HP compressor section 14 entering the cavities 32 and 34 fills the cavities 32, 34 and helps limit or prevent entry of hot combustion gases flowing through the gas path 16F and impinging upon the turbine blades 18B of the HP disc 18R, into the cavities 32 and 34. In an aspect, this helps maintain the disc 18R at a relatively lower temperature than if combustion gases were permitted to freely enter the cavities 32 and 34. Similarly, compressed air from the LP compressor section 12 entering the cavities 36 associated with the LP turbine rotor disc 20R fills these cavities 36 and helps limit or prevent entry of hot combustion gases flowing through the gas path 16F and impinging upon the turbine blades 20B of the LP disc 20R, into the cavities 36. In an aspect, this helps maintain the LP disc 20R at a relatively lower temperature than if combustion gases were permitted to freely enter the cavities 36.

Still referring to FIG. 2, in this embodiment, the air passages 34S and 36S are fluidly separated/segregated from each other, and hence the cavities 34, 36 are fluidly separated from each other, by a partition arrangement 38. In this embodiment, the partition arrangement 38 includes a partition 40 that is disposed between and defines both the cavity 34 and the cavity 36. The partition 40 includes a seal 40B between the cavity 34 and the cavity 36. More particularly, in this embodiment, the partition 40 is defined by a non-rotatable wall portion 40A, the seal 40B sealingly connected to the non-rotatable wall portion 40A, and a nut 40C that is rotatable about the rotation axis (X) with the HP shaft 24 and the disc 18R. The seal 40B, which may be a non-rotatable brush seal or a carbon seal for example, engages an outer surface of the nut 40C to define a fluidly rotational sealed interface 40D between the seal 40B and the nut 40C. The rotational sealed interface 40D, and more broadly the partition arrangement 38, fluidly segregates the air passage 34S from the air passage 36S, and the cavity 34 from the cavity 36.

In this embodiment, the partition arrangement 38 further includes a nut 42 disposed in a central aperture 18A of the HP turbine disc 18R, which extends through the disc 18R and is defined by an radially inward surface of the disc 18R. The nut 42 is secured to the shaft 24 to hold together a stack 44 of components on the shaft 24. The stack 44 includes the HP turbine disc 18R, and one or more components upstream of the disc 18R. For example, in some embodiments, the stack of components 44 may include one or more seals 45 and/or one or more bearings mounted to the shaft 24 for example, as may be suitable for each particular embodiment of the engine 10. In some embodiments, the disc 18R may be the sole component held to the shaft 24 by the nut 42.

In this embodiment, the disc 18R is at a downstream end of the stack 44 and is drivingly connected to the shaft 24 via a spline connection 24S defined by an upstream portion 18S of the disc 18R mounted over the shaft 24, and the shaft 24. As shown, and although this may not be the case in other embodiments, the rest of the disc 18R is axially offset in a downstream direction (DD) from the upstream portion 18S. In this embodiment, the spline connection 24S includes axially-extending splines extending radially outward from the shaft 24 and into driving engagement with corresponding axially extending grooves defined in an axially-extending aperture of the upstream portion 18S of the disc 18R. In other embodiments, the male portion of the spline connection 24S may be on the upstream portion 18S of the disc 18R and the female portion of the spline connection 24S may be on the shaft 24.

As shown in FIG. 2, the nut 42 is secured to the shaft 24 at an upstream end 42A of the nut 42 via a female thread in the upstream end 42 of the nut 42 mated to a male thread on the shaft 24. The nut 42 thereby prevents the upstream portion 18S of the disc 18R, and any other components that may be part of the stack 44, from disengaging from the shaft 24 in the downstream direction (DD). Stated otherwise, the nut 42 engages the disc 18R to secure the spline connection 24S. In an aspect, such an architecture may help reduce a length and/or a weight of the engine 10 in comparison with at least some prior art engines of a similar type and output.

Still referring to FIG. 2, and although this may not be the case in other embodiments, the nut 42 has a length 42L that extends across the central aperture 18A of the HP turbine disc 18R. As an example, in other embodiments, the nut 42 may be shorter so as to not necessarily span a majority of the axial depth of the HP turbine disc 18R. In this embodiment, a downstream end 42B of the nut 42 is received in an aperture 46 in the partition 40 and defines a sealed interface 48 between the downstream end 42B of the nut 42 and the corresponding portion of the partition 40.

The sealed interface 48, which is part of the present embodiment of the partition arrangement 38, fluidly segregates the air passage 34S and the cavity 34 from the air passage 36S and the cavity 36, respectively. To this end, in this embodiment the sealed interface 48 is a close proximity interface which limits flow of air from the air passage 34S and the cavity 34 to the air passage 36S and the cavity 36, respectively. In other embodiments, such as for example in the alternative embodiment shown in FIG. 3, the sealed interface 48 may include a seal 50 disposed therein, to help better fluidly segregate the air passage 34S and the cavity 34 from the air passage 36S and the cavity 36. In the alternative embodiment shown in FIG. 3, the seal 50 is an elastomeric o-ring. However, other types of seals are likewise contemplated.

In this embodiment, the aperture 46 receiving the downstream end 42B of the nut 42 is a central aperture in the radially wider nut 40C that is part of and defines the partition 40. As shown in FIG. 2, in this embodiment, the nut 42 is anti-rotationally secured to the nut 40C via an anti-rotation device 40E. In this embodiment, and although this need not be the case in other embodiments, the anti-rotation device 40E is a keyed washer that rotationally locks the nut 40C relative to the nut 42. In the present embodiment, the direction of the threaded connection 40TH of the nut 40C to the downstream side of the disc 18R is made opposite to the threaded connection 42TH of the nut 42 to the shaft 24. The radially wider nut 40C and the anti-rotation device 40E thereby rotationally secure the nut 42 relative to the shaft 24 and the turbine rotor disc 18R. Thus, in this embodiment, when the shaft 24 is rotated, the disc 18R, the nut 42, the nut 40C and the anti-rotation device 40E rotate with the shaft 24 about the rotation axis (X).

In other embodiments, the aperture 46 receiving the downstream end 42B of the nut 42 may be in a different part of the partition 40. For example, in embodiments in which the partition 40 may not include the nut 40C and/or the anti-rotation device 40E and in which the wall portion 40A may extend closer toward the rotation axis (X) such that the seal 40B may take the place of the nut 40C, the aperture 46, and hence the sealed interface 48, may be defined between the seal 40B and the downstream end 42B of the nut 42. In some such embodiments, the sealed interface 48 defined between the nut 42 and the partition 40 may become the rotational interface 40D.

As seen above, in its various the embodiments, the partition arrangement 38 fluidly segregates the cavity 34 from the cavity 36. At the same time, an outer surface 42S of the nut 42, an inner surface 181S of the HP rotor disc 18R, and a surface of the partition 40 define between each other the air passage 34S that connects to the cavity 34. As seen above, the surface of the partition 40 defining the air passage 34S in this embodiment is a surface of the radially wider nut 40C, but in other embodiments may be different surface of the partition 40.

In this embodiment, the air passage 34S passes through a corresponding aperture (A1) defined in the upstream portion 18S of the disc 18R and through a corresponding aperture (A2) defined in the radially wider nut 40C. It is however contemplated that in other embodiments, one or more of the apertures (A1), (A2) may be defined elsewhere for example. In some alternative embodiments, such as for example where the radially wider nut 40C is omitted, at least the aperture (A2) may be omitted. As shown in FIG. 2, in this embodiment the air passage 36S that connects to the cavity 36 extends through an interface between an inner surface of the nut 42 defining the central aperture 42AA of the nut 42, and an outer surface of the LP shaft 30.

Figure 4:
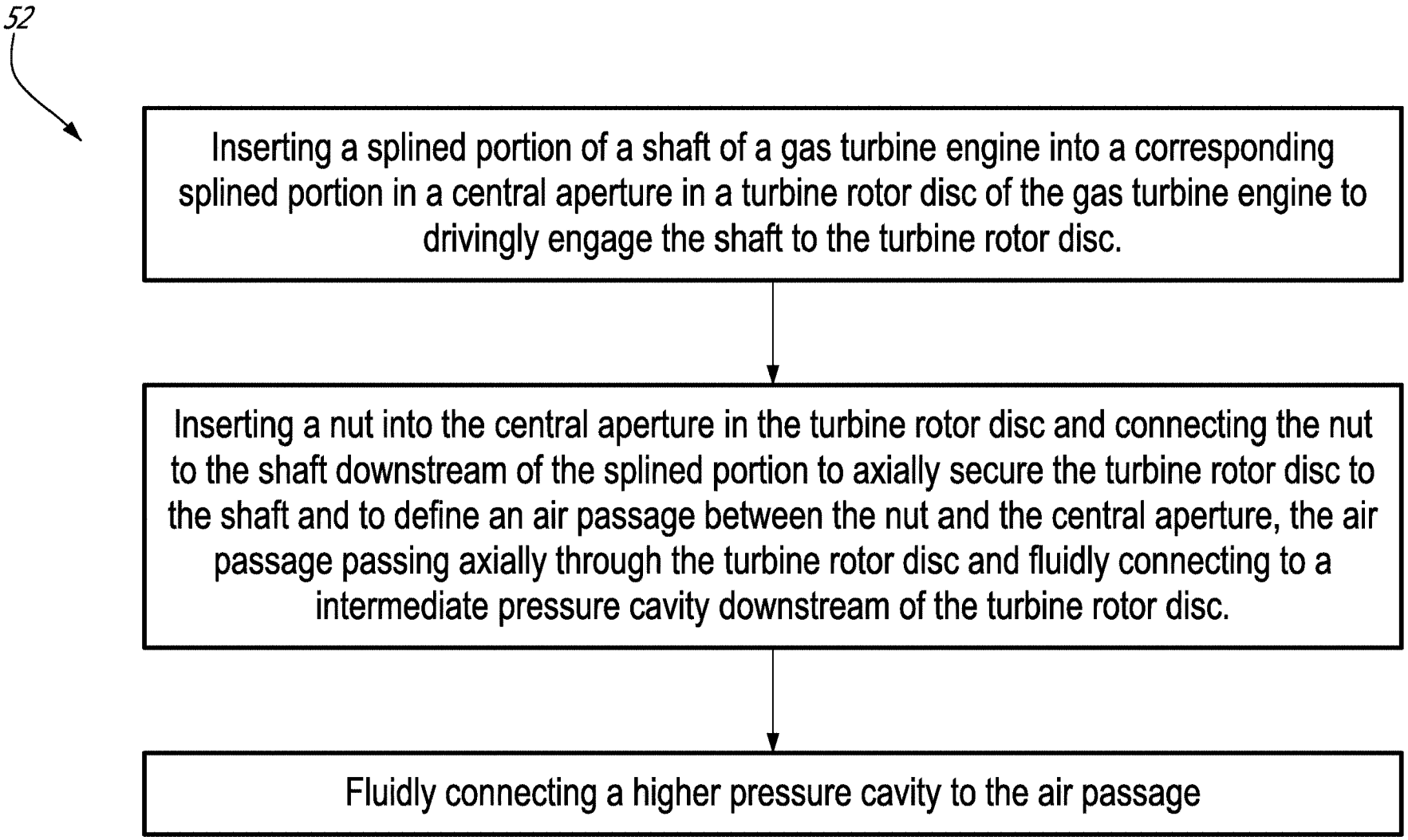
FIG. 4 is a diagram showing a method of fluidly connecting a cavity upstream of a turbine rotor disc of a gas turbine engine to an cavity downstream of the turbine rotor disc while fluidly segregating the cavity from a cavity disposed downstream of the cavity.

With the above structure in mind, and now referring to FIG. 4, the present technology also provides a method 52 of fluidly connecting a cavity, such as the cavity 32 for example, upstream of a turbine rotor disc, such as the HP turbine rotor disc 18R, of a gas turbine engine 10 to an cavity, such as the cavity 34 for example, downstream of the turbine rotor disc 18R while fluidly segregating the cavity 34 from a cavity, such as the cavity 36 for example, disposed downstream of the cavity 34.

In some embodiments, the method 52 may include inserting a splined portion, such as a corresponding portion of the splined connection 24S, of a shaft, such as the HP shaft 24 for example, of the gas turbine engine 10 into a corresponding splined portion, such as the other portion of the splined connection 24S, in a central aperture 18A in the turbine rotor disc 18R to drivingly engage the shaft 24 to the turbine rotor disc 18R.

In some embodiments, the method 52 may include inserting a nut, such as the nut 42 for example, into the central aperture 18A in the turbine rotor disc 18R and connecting the nut 42 to the shaft 24 downstream of the splined portion 24S to axially secure the turbine rotor disc 18R to the shaft 12 and to define an air passage 34S between the nut 42 and the central aperture 18A, the air passage 34S passing axially through the turbine rotor disc 18R and fluidly connecting to the cavity 34.

As seen above, the air passage 34S may be connected to the cavity 34 by defining one or more apertures (A2) through one or more corresponding portions of a partition arrangement 38 of the engine 10. In some embodiments, the method 52 may further include fluidly connecting the cavity 32 to the air passage 34S, such as for example by defining one or more apertures (A1) through one or more corresponding portions of the disc 18R and/or other components that may be in the way in other embodiments.

In some embodiments, the method 52 may further include anti-rotationally securing the nut 42 relative to the shaft 24 and the turbine rotor disc 18R via a second nut and an anti-rotation device, such as with the nut 40C and the keyed washer 40E described above for example.

Figure 5:
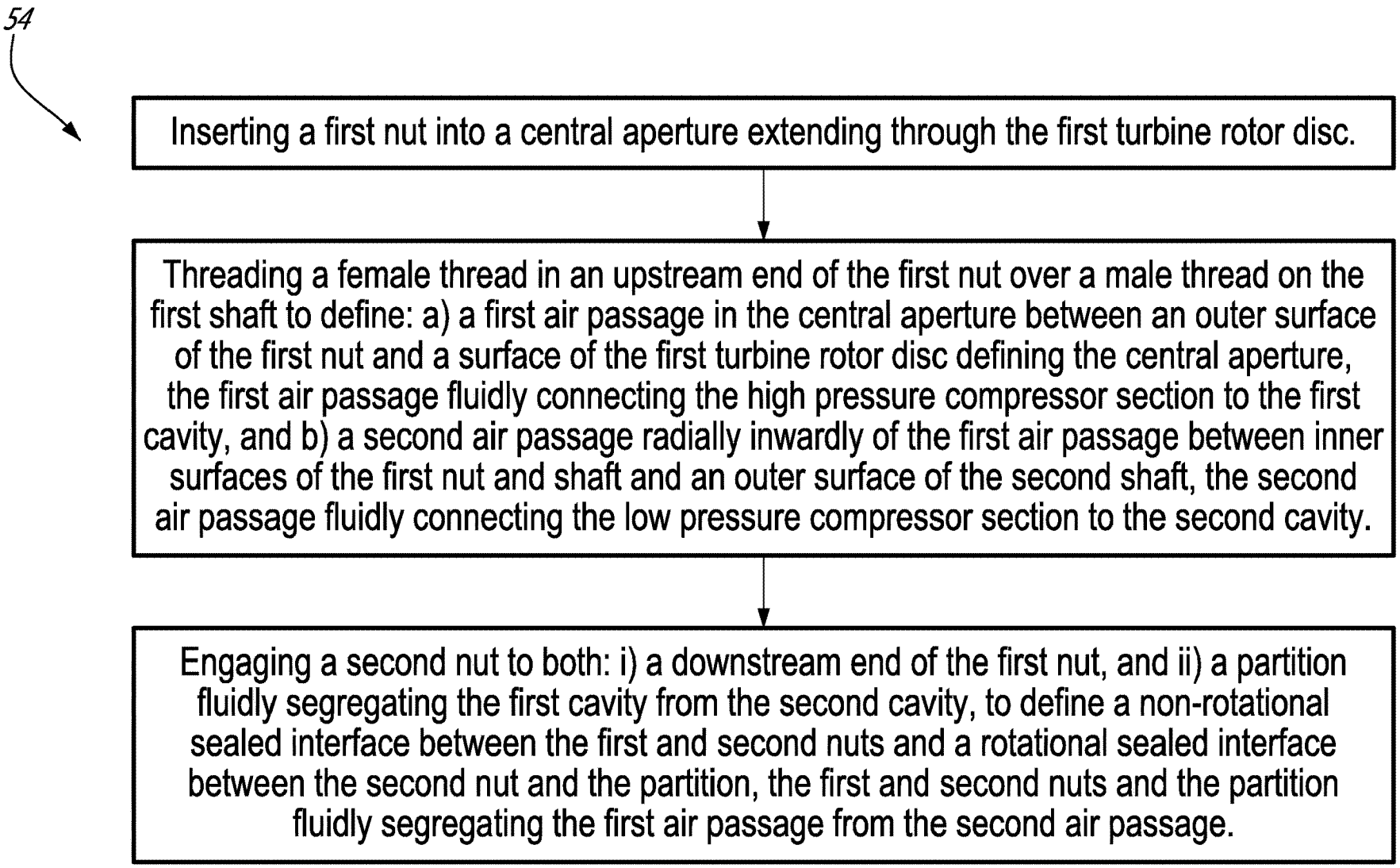
FIG. 5 is a diagram showing another method according to the present technology.

In yet another aspect, and now referring to FIG. 5, the present technology also provides a method 54 of fluidly connecting a HP compressor section 14 of a gas turbine engine 10 to a first cavity, such as the cavity 34, housing a downstream side of a first turbine rotor disc, such as the HP disc 18R, rotatable with a first shaft, such as the HP shaft 24, while fluidly segregating the first cavity 34 from a second cavity, such as the cavity 36, fluidly connected to a LP compressor section 12 of the engine 10 and housing at least a part of a second turbine rotor disc, such as the LP disc 20R, of the engine 10 rotatable with a second shaft, such as the LP shaft 30, that is coaxial with the first shaft 24.

In some embodiments, the method 54 may include inserting a first nut 42 into a central aperture 18A extending through the first turbine rotor disc 18R. The method 54 may also include threading a female thread in an upstream end of the first nut 42 over a male thread on the first shaft 24 to define: a) a first air passage 34S in the central aperture 18A between an outer surface of the first nut 42 and a surface of the first turbine rotor disc 18R defining the central aperture 18A, the first air passage fluidly connecting the HP compressor section 14 to the first cavity 34, and b) a second air passage 36S radially inwardly of the first air passage 34S between inner surfaces of the first nut 42 and shaft 24 and an outer surface of the second shaft 30, the second air passage 36S fluidly connecting the LP compressor section 12 to the second cavity 36.

The method 54 may also include engaging a second nut 40C to both: i) a downstream end 42B of the first nut 42, and ii) a partition 40 fluidly segregating the first cavity 34 from the second cavity 36, to define a non-rotational sealed interface 48 between the first and second nuts 42, 40C and a rotational sealed interface 40D between the second nut 40C and the partition 40. As seen above for example, in such cases, the first and second nuts 42, 40C and the partition 40 may fluidly segregate the first air passage 34S from the second air passage 36S. As seen above, in some embodiments where the second nut 40C may engage the downstream side of the HP disc 18R, one of the steps above may include extending the first air passage 34S through the second nut 40C, for example by defining one or more corresponding apertures through the second nut 40C.

The various components of the engine 10, and the engine 10 itself, described above may be made from any suitable materials and using any suitable engineering and assembly techniques to provide for the arrangements and functionalities described herein and to suit each particular intended application of each particular embodiment of the engine 10. The parts of the engine 10 and its various components and/or aspects that are not described in detail herein may be conventional, and have not been described in detail to maintain clarity of this description.

The above description is meant to be exemplary only, and one skilled in the art will recognize that changes may be made to the embodiments described without departing from the scope of the technology disclosed. For example, as seen in FIGS. 2 and 3, while in the present embodiment the air passage 36S connecting to the cavity 36 is defined in part by an upstream side of a turbine rotor disc 20R disposed downstream of the disc 18R, in other embodiments this may not be the case.

Figure 3:
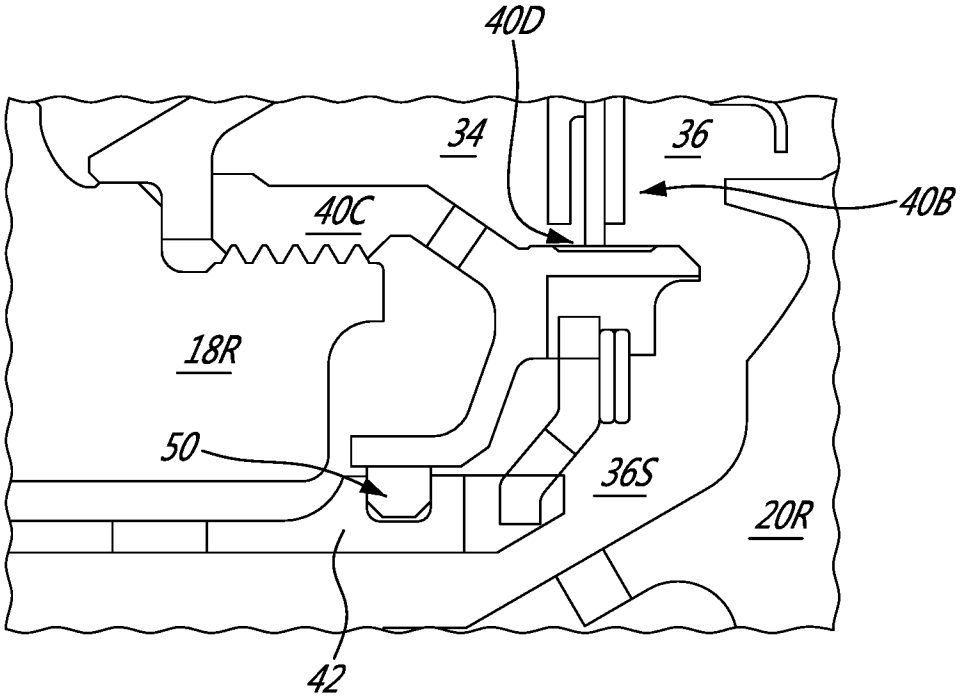
FIG. 3 is a detail section view of a part of a different embodiment of the fastener arrangement of FIG. 2.

As another example, as seen in FIGS. 2 and 3, while in the present embodiment the air passage 36S branches out into a central aperture of the downstream disc 20R, in other embodiments this may not be the case. As yet another example, while a particular arrangement and relative pressures of cavities 32, 34, 36 are described above, it is contemplated that in other embodiments one or more different cavity arrangements and/or numbers of cavities may be used.

Still other modifications which fall within the scope of the present technology will be apparent to those skilled in the art, in light of a review of this disclosure, and such modifications are intended to fall within the appended claims.

The invention claimed is:

1. A turbine rotor assembly for a gas turbine engine, comprising a turbine rotor disc drivingly mounted to a shaft for rotation about a rotation axis and having a central aperture extending coaxially with the shaft through the turbine rotor disc and being defined by a radially inner surface of the turbine rotor disc, a cavity downstream of and housing at least a part of the turbine rotor disc, a nut extending from an upstream end to a downstream end across the central aperture, the upstream end threadingly engaged to the shaft, a first air passage defined between an outer surface of the nut and the radially inner surface of the turbine rotor disc and fluidly connected to the cavity, a second air passage defined radially inward of the first air passage by an inner surface of the shaft and an inner surface of the nut and extending to a location downstream of the cavity, and a seal downstream of the turbine rotor disc cooperating with the nut to fluidly segregate the first air passage from the second air passage.

2. The turbine rotor assembly of claim 1, wherein a female thread is in the upstream end of the nut and mated to a male thread on the shaft, and the downstream end of the nut is received in an aperture in a partition defining the cavity and a second cavity downstream of the cavity, the second cavity housing at least a part of a second turbine rotor disc disposed downstream of the turbine rotor disc, the aperture extending from the cavity to the second cavity, the downstream end of the nut and the partition defining a sealed interface therebetween.

3. The turbine rotor assembly of claim 1, wherein the seal is defined by the outer surface of the nut and one of: an inner surface of a second nut engaged to the nut, and a partition defining the cavity on an upstream side of the partition and a second cavity on a downstream side of the partition.

4. The turbine rotor assembly of claim 3, wherein the seal is a first seal defined by the outer surface of the nut and the inner surface of a second nut engaged to the nut, the second nut is threaded to a downstream side of the turbine rotor disc, and turbine rotor assembly includes a second seal defined by engagement of an outer surface of the second nut to a corresponding surface of the partition.

5. The turbine rotor assembly of claim 4, wherein the nut, the second nut, and the partition cooperate with each other via the first and second seals to fluidly segregate the first air passage from the second air passage.

6. The turbine rotor assembly of claim 5, comprising an anti-rotation device engaging the nut to the second nut.

7. The turbine rotor assembly of claim 6, wherein the second nut rotates with the nut and the partition is non-rotatable.

8. The turbine rotor assembly of claim 7, wherein the second seal is defined by a rotational interface between the outer surface of the second nut and the corresponding surface of the partition.

9. The turbine rotor assembly of claim 8, wherein the rotational sealed interface is a close proximity rotational sealed interface.

10. The turbine rotor assembly of claim 8, wherein the turbine rotor disc is engaged to the shaft via a spline connection and the nut engages the turbine rotor disc to secure the spline connection.

11. The turbine rotor assembly of claim 10, wherein the turbine rotor disc is radially outward of nut and is drivingly mounted to the shaft at an upstream side of the turbine rotor disc, and a downstream side of the turbine rotor disc is axially offset from a downstream end of the shaft in a downstream direction.

12. The turbine rotor assembly of claim 11, wherein the turbine rotor disc is part of a stack of components on the shaft, the stack being held together by the nut.

13. A gas turbine engine comprising:

a shaft rotatable about a rotation axis;

a turbine rotor disc drivingly mounted to the shaft for rotation about the rotation axis and having turbine blades extending into a gas path of the gas turbine engine and a central aperture extending coaxially with the shaft through the turbine rotor disc, the central aperture defined by a radially inner surface of the turbine rotor disc;

a nut secured to the shaft via a female thread of the nut and extending from the female thread through at least a part of the central aperture;

a cavity downstream of and housing at least a part of the turbine rotor disc and fluidly connected to the gas path, the cavity fluidly connected to a high pressure compressor section of the gas turbine engine via a first air passage defined between an outer surface of the nut and the radially inner surface of the turbine rotor disc;

a second air passage defined radially inward of the first air passage by an inner surface of the shaft and an inner surface of the nut and extending to a point downstream of the cavity, the second air passage fluidly connected to a low pressure compressor section of the gas turbine engine; and an outer surface of the nut cooperating with one of: an inner surface of a second nut connecting the nut to the turbine rotor disc, and a partition of the gas turbine engine defining the cavity, to define a seal, the nut and the seal fluidly segregating the first air passage from the second air passage.

14. The gas turbine engine of claim 13, comprising a second cavity disposed downstream of the cavity and housing at least a part of a second turbine rotor disc, the second cavity being connected to the low pressure compressor section via the second air passage.

15. The gas turbine engine of claim 14, wherein the second turbine rotor disc is connected to a second shaft extending through the central aperture and through at least a part of the shaft coaxially with the shaft, and the second air passage is defined at least in part between the inner surfaces of the shaft and the nut, and an outer surface of the second shaft.

16. The gas turbine engine of claim 15, comprising a third cavity upstream of the turbine rotor disc and housing at least a part of the turbine rotor disc, the third cavity being fluidly connected to the high pressure compressor section via a third air passage that is fluidly separated from the first and second air passages.

17. The gas turbine engine of claim 16, wherein the second turbine rotor disc includes turbine blades extending into the gas path, and the cavity, the second cavity, and the third cavity are all fluidly connected to the gas path.

18. The gas turbine engine of claim 17, wherein the turbine rotor disc is engaged to the shaft via a spline connection and the nut engages the turbine rotor disc to secure the spline connection, the seal is defined between the outer surface of the nut and the inner surface of the second nut, the gas turbine engine includes an anti-rotation device engaging the nut to the second nut, and the partition, and an outer surface of the second nut and the partition define a rotational sealed interface between the outer surface of the second nut and the partition, and the seal and the rotational sealed interface fluidly segregate both: the first air passage from the second air passage, and the cavity from the second cavity.

* * * * *